US006301719B1

(12) United States Patent
Goodhand et al.

(10) Patent No.: US 6,301,719 B1
(45) Date of Patent: Oct. 16, 2001

(54) HELMET FACE PROTECTOR ATTACHMENT SYSTEM

(75) Inventors: Stephen Goodhand, Kirkland; Garnet Alexander, Beaconsfield; Hubert Gagnon; Paul Isabelle, both of St-Augustin-de-Desmaures, all of (CA)

(73) Assignee: Itech Sport Products Inc., Montreal (CA)

( * ) Notice: Subject to any disclaimer, the term of this patent is extended or adjusted under 35 U.S.C. 154(b) by 0 days.

(21) Appl. No.: 09/671,274

(22) Filed: Sep. 28, 2000

(51) Int. Cl.[7] ..... A42B 1/24

(52) U.S. Cl. ..... 2/422; 2/424; 24/625; 24/324

(58) Field of Search ..... 2/424, 9, 422, 2/6.3, 6.7; 24/324, 625, 182

(56) References Cited

U.S. PATENT DOCUMENTS

| | | | | |
|---|---|---|---|---|
| 3,139,624 | * | 7/1964 | Humphrey . | |
| 3,259,908 | * | 7/1966 | Simpson et al. . | |
| 4,028,743 | * | 6/1977 | Christensen . | |
| 4,031,564 | | 6/1977 | Wood . | |
| 4,442,551 | * | 4/1984 | Hellberg | 2/424 |
| 4,587,677 | | 5/1986 | Clement . | |
| 4,774,729 | * | 10/1988 | Coates | 2/424 |
| 4,856,109 | | 8/1989 | Desy et al. . | |
| 5,249,347 | * | 10/1993 | Martinitz | 2/9 X |
| 5,287,562 | * | 2/1994 | Rush, III | 2/424 X |
| 5,412,814 | * | 5/1995 | Pernicka et al. | 2/424 |
| 5,440,792 | * | 8/1995 | Ida | 24/615 |
| 5,471,716 | * | 12/1995 | Takahashi | 24/615 |
| 5,479,658 | * | 1/1996 | Harris | 2/9 |
| 5,815,848 | * | 10/1998 | Jarvis | 2/424 |
| 5,987,652 | * | 11/1999 | Fowler | 2/424 |

FOREIGN PATENT DOCUMENTS

| | | | | |
|---|---|---|---|---|
| 3517411 | * | 11/1986 | (DE) | 2/424 |
| 406133809 | * | 5/1994 | (JP) | 24/625 |
| 8604790 | * | 8/1986 | (WO) | 2/424 |

* cited by examiner

*Primary Examiner*—Rodney M. Lindsey
(74) *Attorney, Agent, or Firm*—Swebey Ogilvy Renault; Guy J. Houle

(57) ABSTRACT

The present invention relates to attachments for releasably securing a transparent shield to a wire grid face protector and the wire grid face protector to a helmet. The attachments comprise a clip and a bracket. The clip comprises a retaining body adapted to be secured to the wire grid face protector at a predetermined location and on opposed sides of a sight opening of the wire grid face protector. The retaining body has a guide slot adapted to receive an attachment flange of the transparent shield, and an opening formed in an outer wall thereof configured to receive in abutting engagement a resilient, outwardly inclined tongue of the attachment flange. The bracket comprises a body having a groove into which a wire member of the wire grid face protector is releasably and frictionally retained.

17 Claims, 6 Drawing Sheets

HELMET FACE PROTECTOR ATTACHMENT SYSTEM

BACKGROUND OF THE INVENTION (a) Field of the Invention

The present invention relates to helmet face protectors and more particularly to attachments for releasably securing a transparent shield to a wire grid face protector, and the wire grid face protector to a helmet.

(b) Description of Prior Art

Protective helmets are used in sports such as hockey to protect the wearers from head injuries caused by impacts.

Face protectors attachable to hockey helmets are known. Such face protectors generally consist of a wire grid which substantially covers the face of the wearer. The grid defines a plurality of apertures sufficiently small to prevent passage of hockey sticks and pucks. A large, elongated sight opening is found in the grid and extends in front of the wearer's eyes not to obstruct the wearer's field of vision. A curved, resilient transparent shield of molded high impact resistant plastic material is generally attached to the grid to cover the sight opening and protect the wearer's eyes without hindering the wearer's field of vision.

Different fastening means have been used to secure wire grids to helmets and to fasten shields to wire grids. For example, U.S. Pat. No. 4,031,564 issued to Wood on Jun. 28, 1977 describes a protective face mask including a resilient transparent shield and a wire grid. The shield is provided with tabs at opposed ends thereof bearing outwardly extending projections, to secure to the wire grid at each end of the elongated sight opening of the grid. The shield is flexed to allow insertion of the tabs into grid receptacles to engage the projections thereon. A mounting plate having bolt holes is also secured to the wire grid by fasteners.

A disadvantage of such an attachment is that the shield can be accidentally dislodged upon impact on a side of the helmet. Another disadvantage is that the wire grid can not be quickly and easily removed from the helmet.

U.S. Pat. No. 4,587,677 issued to Clement on May 13, 1986 describes an attachment system for attaching a face mask having a wire grid to a helmet using a hinge and a snap-fit connection. The hinge has two resilient halves integrally hinged together and having a cavity for receiving a wire of the grid. The hinge is retained in a slot in the forehead region of the helmet by the resilient action of the clip halves. The snap-fit connection consists of two vertical slots integrally formed in either side of the helmet and open at the bottom for receiving tabs vertically extending from either side of the face mask. Each tab has two side portions between which is integrally formed a resilient, angulated, outwardly extending tongue connected to the side portions at the upper corners thereof. The tab is retained in the slot by the outward position of the tongue, and is released therefrom by inwardly pressing on the tongue and by pushing the tab downwardly. However, the face mask does not provide a transparent shield which is detachable from the wire grid.

U.S. Pat. No. 4,856,100 issued to Desy et al. on Aug. 15, 1989 describes a face shield detachably connected to a visor. The visor defines a recess in the lower edge thereof to receive the upper edge of the face shield, and has inwardly extending star-shaped detents integrally molded at either side thereof and a wedge-shaped detent integrally molded at the front thereof to correspond with through-holes in the face shield, to receive and engage the detents.

It would therefore be highly desirable to provide an attachment for connecting a transparent shield to a wire grid that would be resistant to dislodgment, that would be removably attachable to the transparent shield and to the wire grid face protector and that would also render the transparent shield quickly releasable and attachable to and from the wire grid face protector.

It would also be highly desirable to provide an attachment for connecting a wire grid to a helmet that would allow the wire grid to be quickly swung away from the face of the wearer, and which could also be easily and quickly secured and removed from the helmet.

SUMMARY OF THE INVENTION

One feature of the present invention is to provide an attachment for connecting a transparent shield to a wire grid which is resistant to dislodgment and which is removably attachable to the wire grid face protector by quick release connectors.

Another feature of the present invention is to provide an attachment for securing a wire grid to a helmet which allows the wire grid to be quickly swung away from the face of the wearer and which is easily and quickly secured and removed from the helmet.

In accordance with the above-mentioned features, from a broad aspect, the present invention provides a clip for releasably securing a transparent shield to a wire grid face protector. The clip comprises a retaining body adapted to be secured to a wire grid face protector at a predetermined location and on opposed sides of a sight opening formed in the wire grid face protector. The retaining body has a guide slot adapted to receive therein an attachment flange of a transparent shield. An opening is formed in an outer wall of the body and configured to receive in abutting engagement a resilient, outwardly inclined tongue of the attachment flange. The transparent shield is disconnectable from the retaining body and hence the wire grid face protector by inwardly depressing the tongue in the opening and by pulling the tongue out of the slot.

The retaining body may be releasably secured to the wire grid face protector by engaging wire members of the grid in opposed channels defined in opposed edges of the clip.

In accordance with another broad aspect, the present invention also provides a wire grid face protector in combination with the above-described clip for releasably securing a transparent shield over a sight opening formed in the wire grid face protector.

In accordance with a further broad aspect, the present invention provides a bracket for releasably securing a wire grid face protector to the forehead region of a helmet. The bracket comprises a body adapted for securement to the helmet and forming a groove into which a wire member of the wire grid face protector is releasably and frictionally retained. A wire member of the wire grid face protector is disposed at a predetermined location and adapted to snap-fit into the bracket.

In accordance with a still further broad aspect of the present invention, there is provided a transparent shield which is releasably securable to a wire grid face protector. The transparent shield comprises securement means for releasably securing the transparent shield to the wire grid face protector. The securement means is constituted by attachment flanges disposed at opposed ends of the transparent shield and adapted for insertion into a clip which is secured to the wire grid face protector. The flanges have a resilient, outwardly inclined tongue configured to abuttingly engage in an opening of the clip.

The attachment flange and tongue may be integrally formed with the transparent shield.

The tongue extends at an angle outwardly of the plan of the outer surface of the flange to define an abutment edge.

In accordance with a further broad aspect of the present invention, there is provided a helmet comprising such a bracket secured centrally adjacent a top edge of the frontal portion thereof for releasably securing a wire grid face protector thereto.

BRIEF DESCRIPTION OF THE DRAWINGS

Having thus generally described the nature of the invention, reference will now be made to the accompanying drawings, showing by way of illustration a preferred embodiment thereof, and in which.

DETAILED DESCRIPTION OF THE INVENTION

Figure 1:
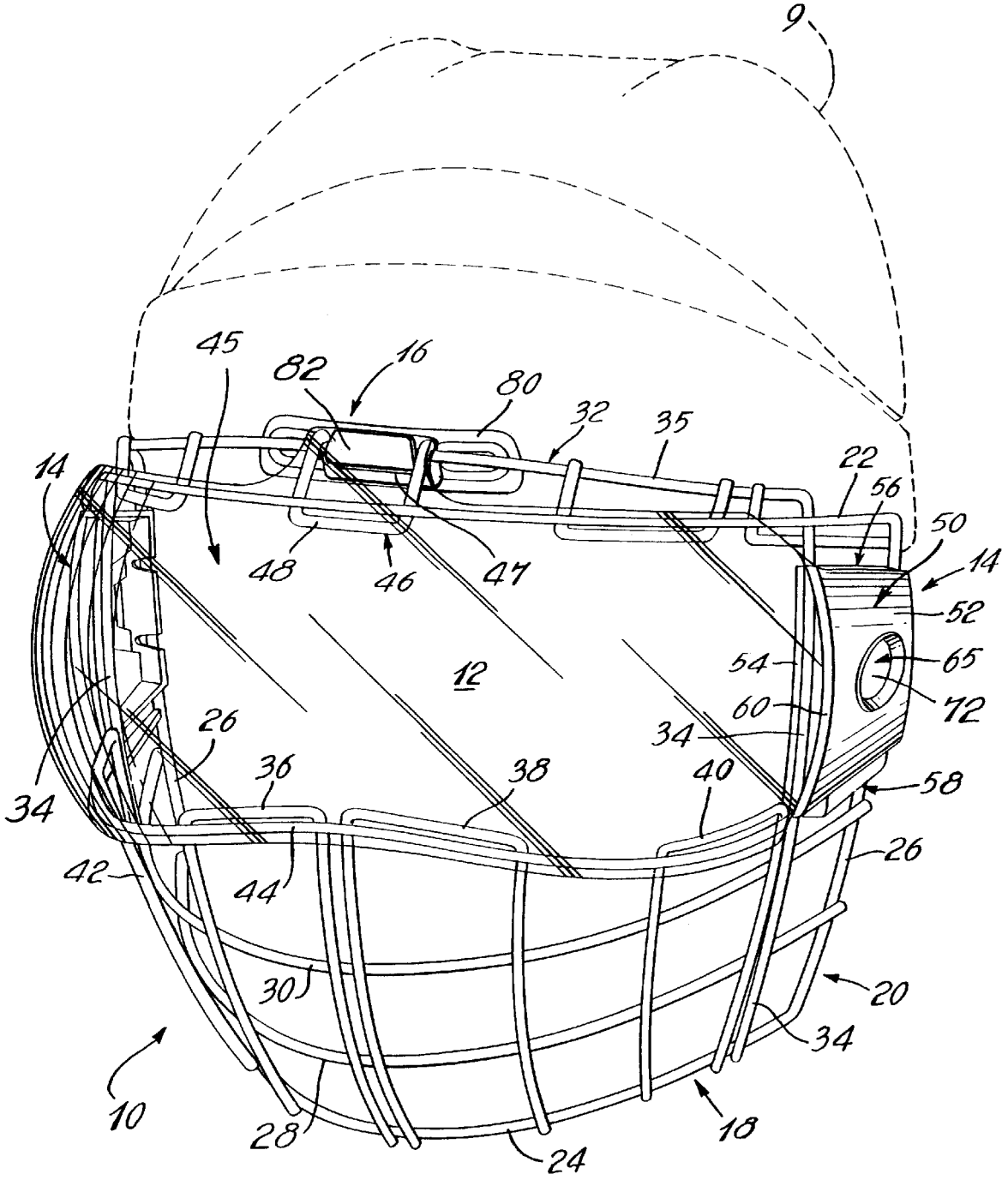
FIG. 1 is a perspective view of a clip for securing a transparent shield to a wire grid face protector and constructed in accordance with the present invention.
Figure 2:
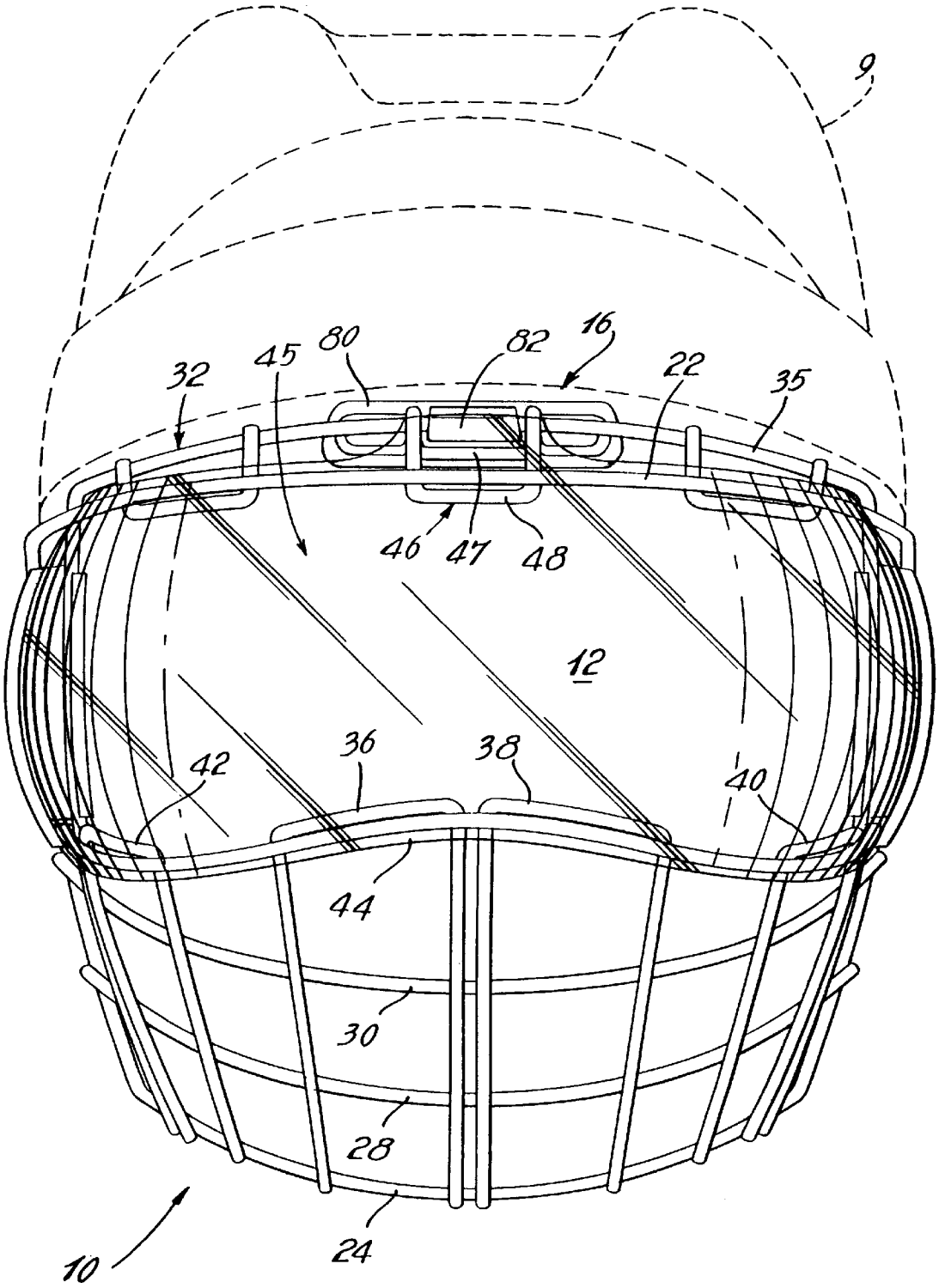
FIG. 2 is a front view of the transparent shield secured to the wire grid face protector as shown in FIG. 1.

Referring to FIGS. 1–2, there is shown a wire grid 10 having a curved, flexible transparent shield 12 releasably secured thereto using a clip 14 constructed in accordance with the present invention. A bracket 16 releasably secures the wire grid 10 to a helmet 9 having a head protective shell shown in phantom lines.

The wire grid 10 includes a plurality of intersecting wires 18 welded together at intersecting points. A peripheral wire 20 has a top portion 22 and a bottom portion 24 joined by side wire portions 26. A first and a second substantially horizontal wires 28, 30 extend from one side portion 26 to another and are disposed above the bottom portion 24 of the peripheral wire 20 and spaced apart therefrom and from one another. An inverted U-shaped wire 32 has upright portions 34 joined by a top portion 35 and welded under the top portion 22 of the peripheral wire 20 and over the first and second horizontal wires 28, 30 and the bottom portion 24 of the peripheral wire 20. A first and a second smaller inverted U-shaped wires 36, 38 are disposed adjacent one another over the first and second horizontal wires 28, 30 and at the center thereof, with ends thereof being co-terminous with the bottom portion 24 of the peripheral wire 20 and forming loops extending above the second horizontal wire 30. A third and a fourth smaller inverted U-shaped wires 40, 42 are disposed at either side of the first and second smaller inverted U-shaped wires 36, 38 spaced apart therefrom and adjacent either upright portion 34 of the inverted U-shaped wire 32, also with ends thereof being co-terminous with the bottom portion 24 of the peripheral wire 20 and forming loops extending above the second horizontal wire 30. A third substantially horizontal wire 44 extends from one side portion 26 of the peripheral wire 20 to another and is disposed above and spaced apart from the second horizontal wire 30. The wire 44 is welded over the smaller inverted U-shaped wires 36, 38, 40, 42 and over either side wire portion 26 of peripheral wire 20. The third horizontal wire 44, the top portion 22 of the peripheral wire 20 and upright portions 34 of the inverted U-shaped wire 32 form a sight opening 45, which is positioned to extend adjacently to the wearer's eyes and to substantially encompass the wearer's field of vision. The sight opening 45 is covered by the transparent shield 12, which is releasably secured to the wire grid 10 as will be explained hereinafter. Similar U-shaped wires are welded above the window 45 to join the top portion 22 of the peripheral wire 20 and the top portion 35 of the inverted U-shaped wire. The wires 18 are disposed to define a plurality of apertures dimensioned to prevent passage of hockey sticks and pucks to protect the face of the wearer.

Figure 6A:
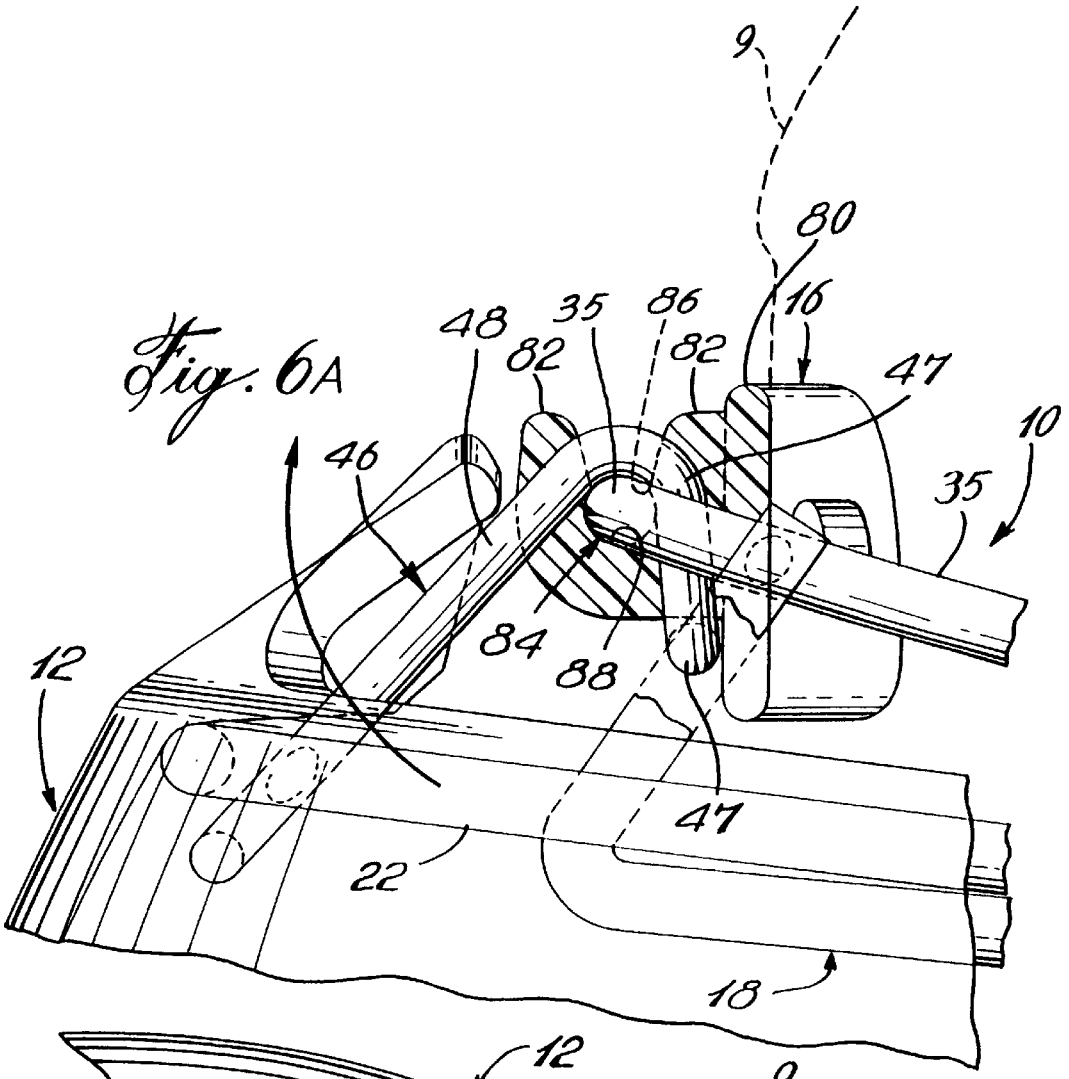
FIG. 6A is a partly sectioned view of the wire grid face protector mounted to the helmet and shown in a lowered position.
Figure 6B:
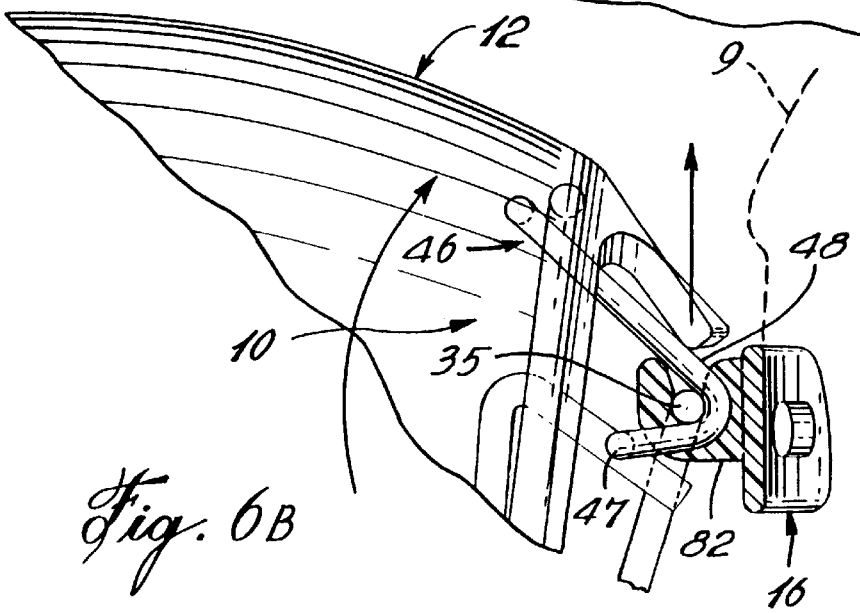
FIG. 6B is a section view taken of the wire grid face protector shown in FIG. 6A and illustrated in a raised position.

Referring now to FIGS. 6A–6B, a loop-shaped wire 46 has a rear hook portion 47 and a front securement portion 48. The loop-shaped wire 46 is bent over the central top portion 35 of the inverted U-shaped wire 32 and welded under the top portion 22 of the peripheral wire 20 in the rear hook portion 47 defining therein an inwardly angled hook relative to the front securement portion 48. The front securement portion 48 of the loop-shaped wire 46 is in the plan of the wire grid.

Figure 3:
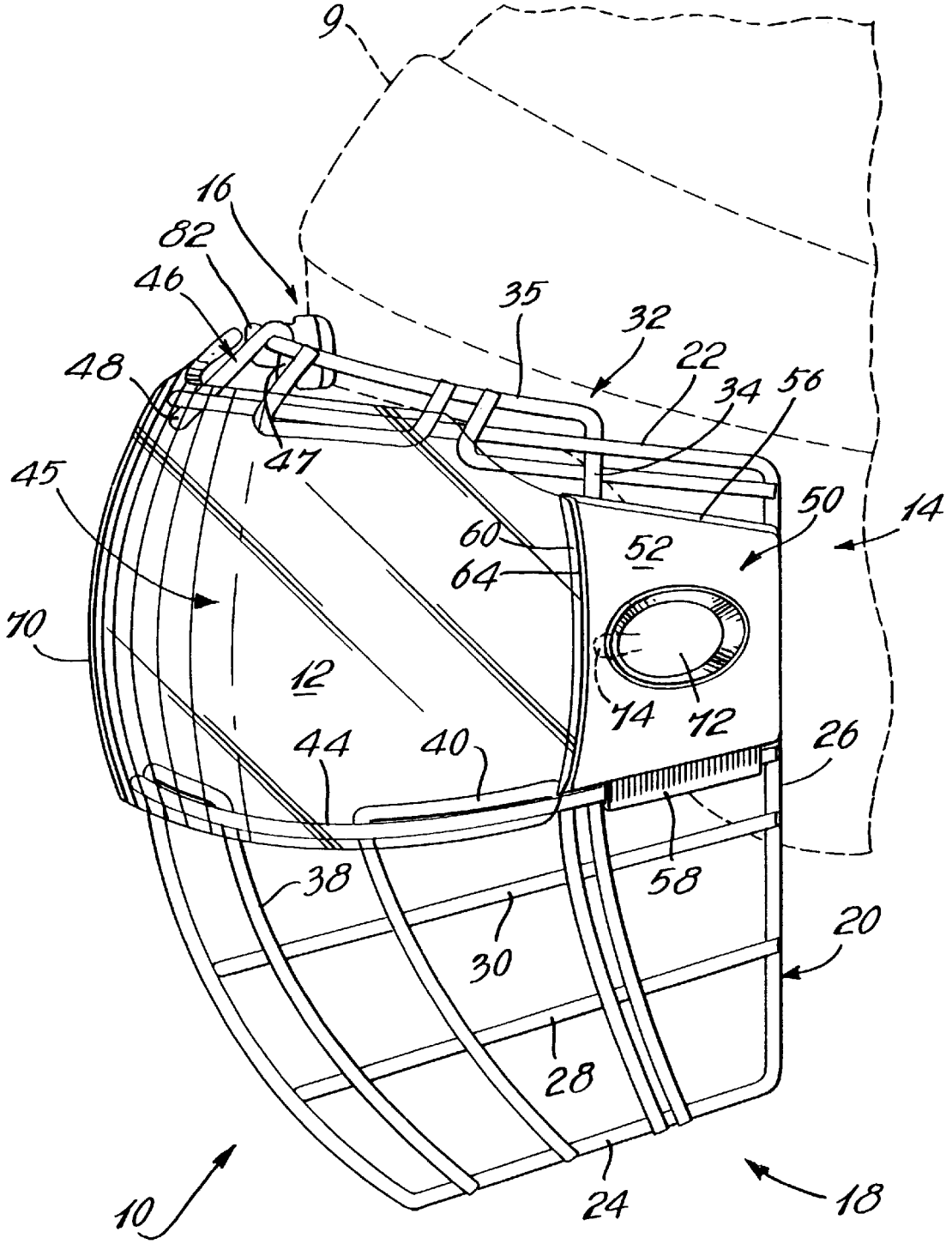
FIG. 3 is a side view of the clip mounted to the wire grid face protector and securing the transparent shield thereto, as shown in FIG. 1.

Referring now to FIGS. 1–3, two clips 14 are disposed at either side of the wire grid 10, between the side portion 26 of the peripheral wire 20 and the upright portions 34 of the inverted U-shaped wire 32. Each clip 14 has a body 50 having an outer wall 52 and an inner wall 54 joined by an upper wall 56, a lower wall 58 and opposed side edges 60. Each side wall 60 forms a groove 62 adapted to snap-fit to the upright portion 34 of the inverted U-shaped wire 32 and the side portion 26 of the peripheral wire 20, respectively. The side edge 60 proximal to a vertical plan perpendicularly crossing the center of the wire grid 10 defines a guide slot 64 adjacent the groove 62 and outwardly disposed with respect thereof. Each guide slot 64 receives a flange 66 disposed at either ends of the shield 12, to releasably secure same thereto, as explained hereinafter. The outer wall 52 of the body 50 defines an opening 65 for abutting engagement by a resilient outwardly inclined tongue 72 of the flange 66. The opening 65 is sized to allow the wearer to manually inwardly press the tongue 72 therethrough by the use of a finger.

Figure 4A:
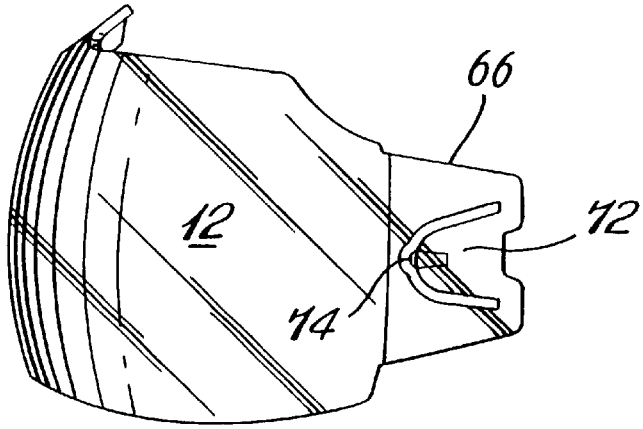
FIG. 4A is a side view of a transparent shield constructed in accordance with the present invention.
Figure 4B:
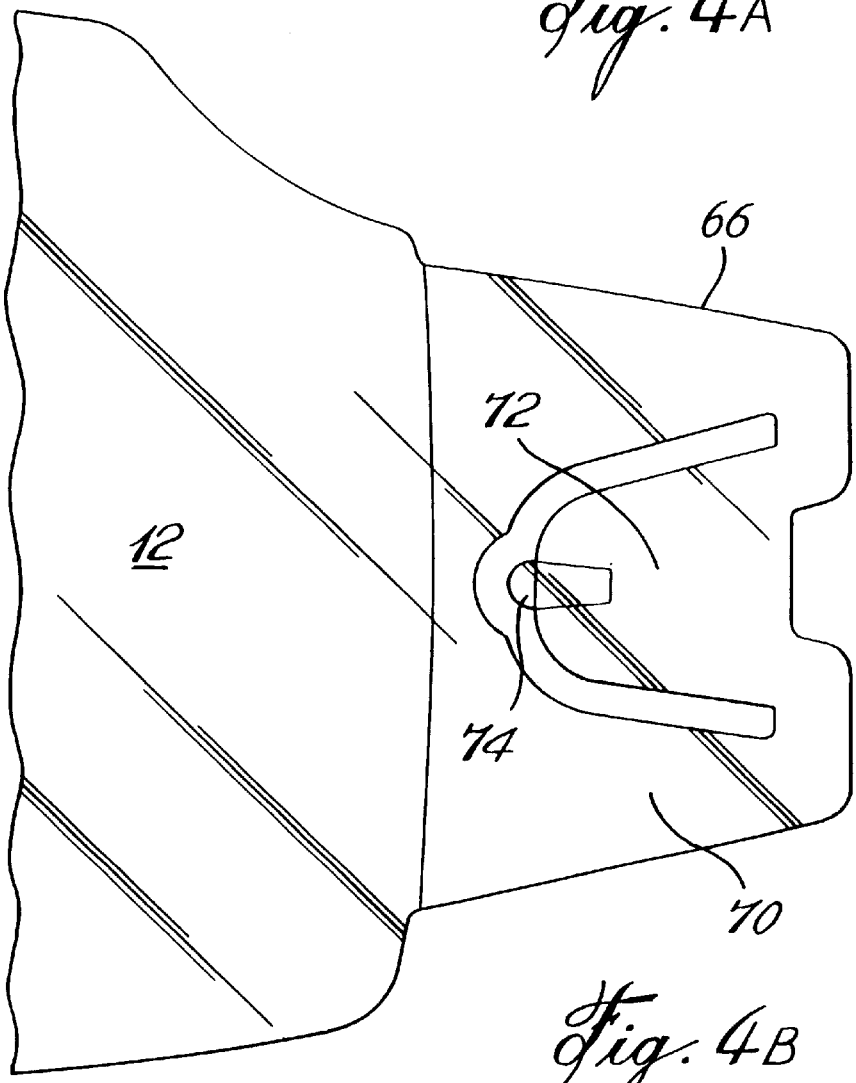
FIG. 4B is an enlarged side view of the transparent shield shown in FIG. 4A, showing the attachment flange.

Referring now to FIGS. 4A–4B, it can be seen that the ends of the shield 12 are integrally provided with a flange 66 having an inner surface 68 and an outer surface 70. The flange 66 is adapted to be received snugly but slidably into the guide slot 64 of the clip 14. The flange 66 is integrally provided with a tongue 72 having its base connected to the flange 66 near the free end thereof. The tongue 72 is molded in an outward angled projection with respect to the flange 66. A finger 74 is integrally provided at the top of the tongue 72 and extends inwardly of the inner surface 68 of the flange 66. The transparent shield 12 is molded from an impact resistant plastic material. The finger 74 is configured to engage in a groove formed in the inner wall defining the guide slot 74.

Figure 5:
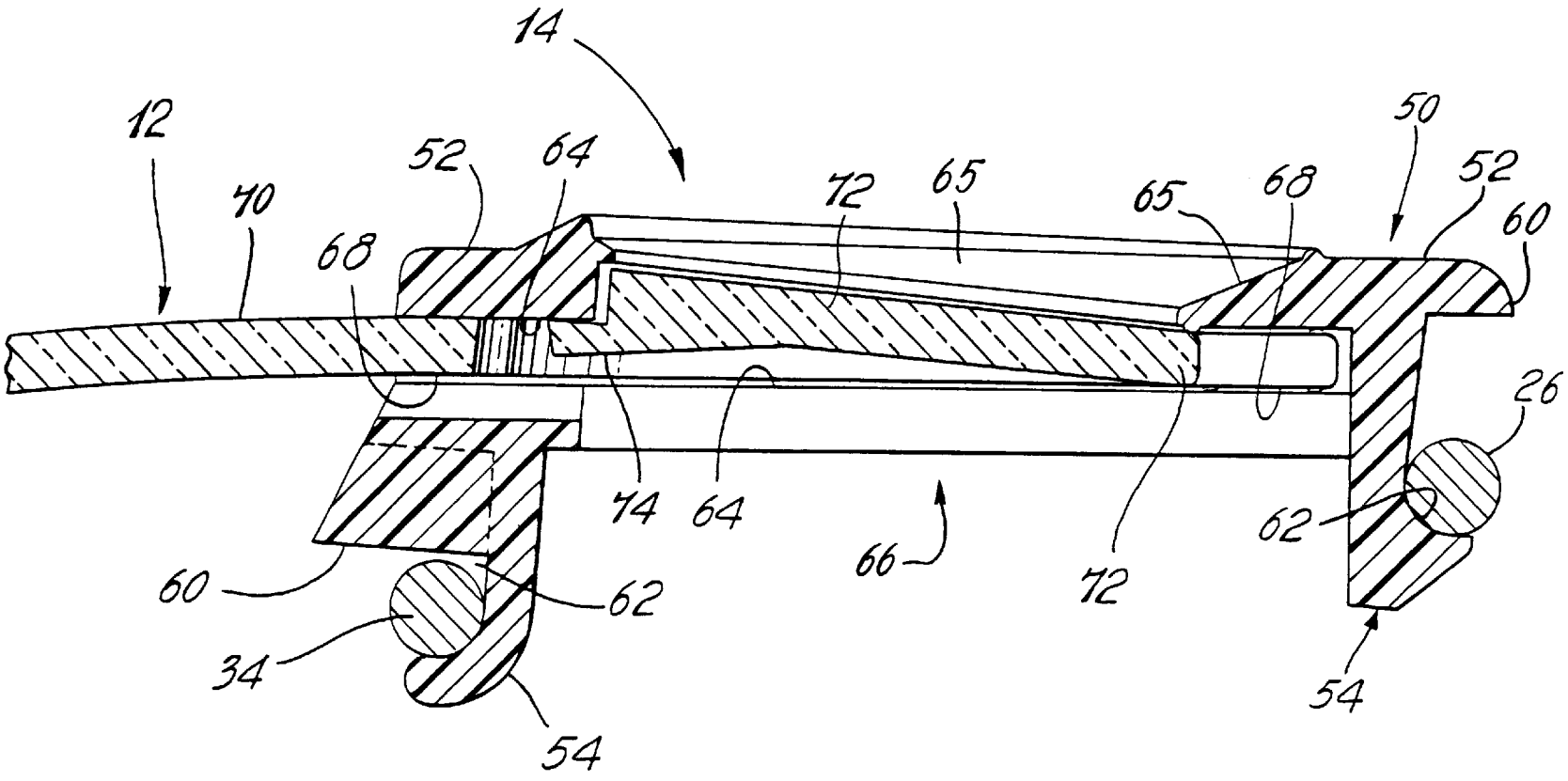
FIG. 5 is a section view of the clip with the attachment flange engaged therein.

FIG. 5 shows, in a cross-section, the flange 66 inserted in the clip 14, and the tongue 72 engaged in the opening 65.

As the flange 66 is inserted into the guide slot 64, the tongue 72 is urged inwardly to a position of alignment with the flange 66 by the inner wall of the guide slot 64. When the end of the flange 66 touches the bottom of the guide slot 64, the tongue 72 rises by its resilient action to its normal inclined position which provides an abutment between the outer surface of the tongue 72 and the outer wall 52 of the clip 14.

In order to release the flanges 66 from the clips 14, wearer merely presses inwardly on the tongues 72 of the respective flanges 66 through the openings 65, and then pulls the shield 12 in order to pull the tongues 72 through the guide slots 64. At this point, there is no further interference by the tongue 72 to retain the flange 66 in place in the clip 14, and the wearer may simply pull the shield 12 out of engagement.

As seen in FIGS. 1–3, 6A and 6B, a bracket 16 secures the wire grid 10 to the helmet 9. The bracket 16 has a body 80 with two holes at opposed ends thereof for the insertion of fasteners therethrough, to secure the bracket 16 to the forehead region of the helmet 9. A U-shaped holder 82 extends outwardly from the face of the body 80 and is elongated in the plan at right angle to the page. The holder 82 is of a maximum height to ensure insertion in the loop formed by the ring-shaped wire 46, as described hereinbefore. The U-shaped elongated holder 82 forms a groove 84 into which snap-fits the top portion 35 of the inverted U-shaped wire 32 of the wire grid 10.

As shown in FIGS. 6A–6B, the groove 84 has a flared entry portion having a shoulder 86 joining a semi-cylindrical cavity 88 which receives the top portion 35 of the inverted U-shaped wire 32 and allows same to easily rotate therein. The flared entry portion and the shoulder 86 allow the wire 35 to be retained in the cavity 88.

The bracket 16 has the top portion 35 of the inverted U-shaped wire 32 engaged therein. The wire grid 10 pivots with respect to the bracket 16 from a lowered position, corresponding to hook portion 47 of the ring-shaped wire 46 abutting the body 80 of the bracket 16, to a raised position, corresponding to the U-shaped portion 48 of the ring-shaped wire 46 abutting the body 80 of the bracket 16 by the rotation of the top portion 35 of the inverted U-shaped wire 32 into the groove 84. The wire grid 10 is detached from the bracket 16 by upwardly pivoting the wire grid 10 to a raised position and by then lifting same to snap the top portion 35 of the inverted U-shaped wire 32 out of the holder 82.

While the invention has been described with particular reference to the illustrated embodiment, it will be understood that numerous modifications thereto will appear to those skilled in the art. Accordingly, the above description and accompanying drawings should be taken as illustrative of the invention and not in a limiting sense.

What is claimed is:

1. A clip for releasably securing a transparent shield to a wire grid face protector of a helmet, said clip comprising a retaining body adapted to be secured to a wire grid face protector at a predetermined location and on opposed sides of a sight opening formed in said wire grid face protector, said retaining body having a guide slot adapted to receive therein an attachment flange of a transparent shield, and an opening in an outer wall of said retaining body configured to receive in abutting engagement a resilient, outwardly inclined tongue of said attachment flange, said transparent shield being disconnectable from said clip by inwardly depressing said tongue in said opening and pulling said tongue from said guide slot.

2. A clip according to claim 1, wherein said retaining body is provided with opposed channels to secure same to said wire grid face protector by engaging opposed wire members thereof in opposed grooves defined by opposed walls of said clip.

3. A clip according to claim 2, wherein said grooves are formed in side edge walls of said clip.

4. A clip according to claim 3, wherein said retaining body is curved to correspond to a curvature of said attachment flange.

5. A clip according to claim 4, wherein an inner wall of said guide slot is provided with a groove for receiving a finger extending from an inner face of said tongue.

6. A clip according to claim 5, wherein said helmet is a hockey helmet.

7. A wire grid face protector for a helmet in combination with a clip for releasably securing a transparent shield over a sight opening formed in said wire grid face protector, said clip comprising a retaining body secured at a predetermined location and on opposed sides of said sight opening formed in said wire grid face protector, said retaining body having a guide slot adapted to receive therein an attachment flange of a transparent shield, and an opening formed in an outer wall of said retaining body configured to receive in abutting engagement a resilient, outwardly inclined tongue of said attachment flange, said transparent shield being disconnectable by inwardly depressing said tongue in said opening and pulling said tongue from said guide slot.

8. A wire grid face protector according to claim 7, comprising a wire member disposed at a predetermined location and adapted to snap-fit into a bracket securable to a helmet, for releasably securing said wire grid face protector to said helmet, said bracket comprising a body forming a groove into which said wire member is releasably and frictionally retained.

9. A wire grid face protector according to claim 8, wherein said helmet is a hockey helmet.

10. A bracket for releasably securing a wire grid face protector of a helmet to a forehead region of a helmet, said bracket comprising a body adapted for securement to said helmet and forming a groove into which a top horizontal attachment wire member of said wire grid face protector is releasably and frictionally retained, said wire grid face protector also having a rear horizontal wire hook portion for being disposed in close proximity under said body, said body configured to engage said hook portion to prevent said wire grid face protector to disconnect from said bracket unless said face protector is hinged outwardly a predetermined distance.

11. A bracket according to claim 10, wherein said helmet is a hockey helmet.

12. A transparent shield releasably securable to a wire grid face protector of a helmet, said transparent shield comprising securement means for releasably securing said transparent shield to said wire grid face protector, said securement means being constituted by attachment flanges disposed at opposed ends of said transparent shield and adapted for insertion into a clip securable to said wire grid face protector, said flanges having a resilient, outwardly inclined tongue which defines an abutment edge projecting outwardly and configured to abuttingly engage in an opening of said clip, said tongue being accessible outwardly of said clip whereby to be depressed inwardly to be disconnected forms aid clip.

13. A transparent shield according to claim 12, wherein said attachment flange and said tongue are integrally formed with said transparent shield.

14. A transparent shield according to claim 13, wherein said tongue extends at an angle outwardly of an outer surface of said flange.

15. A transparent shield according to claim 14, wherein said tongue has a finger extending from an inner face thereof and configured to engage in a groove formed in an inner wall defining said guide slot.

16. A helmet comprising a head protective shell, a bracket secured to a forehead region of said shell for releasably securing a wire grid face protector thereto, said bracket comprising a body having a groove into which a wire member of said wire grid face protector is adapted to snap-fit, said wire grid face protector comprising a pair of clips for releasably securing a transparent shield to said wire grid face protector, each said clip being releasably secured to opposed sides of a sight opening in said wire grid face protector, each clip comprising a retaining body having a guide slot for receiving therein an attachment flange of said transparent shield, and an opening in an outer wall of said clip and configured to receive in abutting engagement a resilient, outwardly inclined tongue of said attachment flange.

17. A helmet according to claim 15, wherein said helmet is a hockey helmet.

* * * * *